US008100272B1

(12) United States Patent
Schaefer

(10) Patent No.: US 8,100,272 B1
(45) Date of Patent: Jan. 24, 2012

(54) PAINTING TOOL CLEANING MOUNT ASSEMBLY AND METHOD

(76) Inventor: Jackie Schaefer, Watertown, SD (US)

( * ) Notice: Subject to any disclaimer, the term of this patent is extended or adjusted under 35 U.S.C. 154(b) by 358 days.

(21) Appl. No.: 12/423,038

(22) Filed: Apr. 14, 2009

(51) Int. Cl.
*A47B 81/02* (2006.01)

(52) U.S. Cl. ..... 211/65

(58) Field of Classification Search ..... 211/65, 211/66, 181.1, 125, 89.01, 124, 61, 106.01, 211/85.12, 85.9, 85.5, 41.4, 41.2, 41.8, 41.9, 211/119, 12, 85.15, 85.31; 248/153, 110, 248/112, 175; 134/900
See application file for complete search history.

(56) References Cited

U.S. PATENT DOCUMENTS

| | | | | |
|---|---|---|---|---|
| 1,176,009 | A | 3/1916 | Weimar | |
| 1,409,228 | A * | 3/1922 | Marshall | 211/125 |
| D119,969 | S | 4/1940 | Teetor | |
| 2,310,533 | A | 9/1943 | Lindell | |
| 2,472,001 | A * | 5/1949 | Buhoveckey | 206/209 |
| 2,682,956 | A * | 7/1954 | Pike | 211/85.15 |
| 2,744,635 | A * | 5/1956 | Hiss | 211/65 |
| 2,868,385 | A * | 1/1959 | Dreyfus, Jr. | 211/85.31 |
| 2,952,364 | A * | 9/1960 | Jacobson | 211/65 |
| 4,377,239 | A | 3/1983 | Jimae | |
| 4,607,752 | A | 8/1986 | Sherrow | |
| 4,944,415 | A * | 7/1990 | Orbach | 211/75 |
| 5,016,773 | A | 5/1991 | Lockwood | |
| 5,038,943 | A * | 8/1991 | Reinke | 211/59.1 |
| D324,541 | S * | 3/1992 | Dudley | D19/35 |
| 5,097,967 | A | 3/1992 | Slca | |
| D378,248 | S | 3/1997 | Griffin | |
| 5,641,007 | A | 6/1997 | Falk | |
| 5,645,091 | A | 7/1997 | Hoeft | |
| 5,669,515 | A | 9/1997 | Tisbo et al. | |
| 5,740,928 | A * | 4/1998 | Dale et al. | 211/71.01 |
| 5,791,534 | A | 8/1998 | Davis et al. | |
| 5,833,080 | A * | 11/1998 | Donne | 211/85.31 |
| D431,701 | S | 10/2000 | Castillo | |
| 6,193,080 | B1 | 2/2001 | Castillo | |
| 6,667,079 | B1 * | 12/2003 | Glenn | 428/10 |
| D542,536 | S * | 5/2007 | Gialanella | D3/315 |
| 7,234,602 | B2 | 6/2007 | Roberti | |
| 7,281,469 | B1 * | 10/2007 | Barbour et al. | 99/426 |
| 7,770,741 | B2 * | 8/2010 | Oliver | 211/85.11 |
| 2002/0144963 | A1 * | 10/2002 | Mood | 211/85.15 |
| 2006/0102573 | A1 * | 5/2006 | Alvarado | 211/85.15 |
| 2006/0289367 | A1 * | 12/2006 | Cossey | 211/13.1 |
| 2008/0149577 | A1 * | 6/2008 | Lin et al. | 211/85.31 |

* cited by examiner

*Primary Examiner* — Jennifer E. Novosad

(57) ABSTRACT

A painting tool cleaning mount assembly includes a central member and a plurality of legs attached to and extending downwardly from the central member to support the central member on a support surface. Each of the legs includes a vertically orientated paint roll receiving stanchion for receiving a paint roller. A plurality of hooks is attached to the central member. The hooks are extendable through apertures in handles of paintbrushes to removably hang the paint brushes from the central member. The central member is positionable in a dishwasher to clean the paint rollers and the paint brushes.

9 Claims, 4 Drawing Sheets

PAINTING TOOL CLEANING MOUNT ASSEMBLY AND METHOD

BACKGROUND OF THE INVENTION

1. Field of the Invention

The present invention relates to paint brush and roller cleaning and drying aids and more particularly pertains to a new paint brush and roller cleaning and drying aid for providing a mounting platform to vertically orientate paint brushes and paint rollers so that they may be cleaned by a conventional dishwasher.

2. Summary of the Invention

The present invention meets the needs presented above by generally comprising a central member and a plurality of legs attached to and extending downwardly from the central member to support the central member on a support surface. Each of the legs includes a vertically orientated paint roll receiving stanchion for receiving a paint roller. A plurality of hooks is attached to the central member. The hooks are extendable through apertures in handles of paintbrushes to removably hang the paint brushes from the central member. The central member is positionable in a dishwasher to clean the paint rollers and the paint brushes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
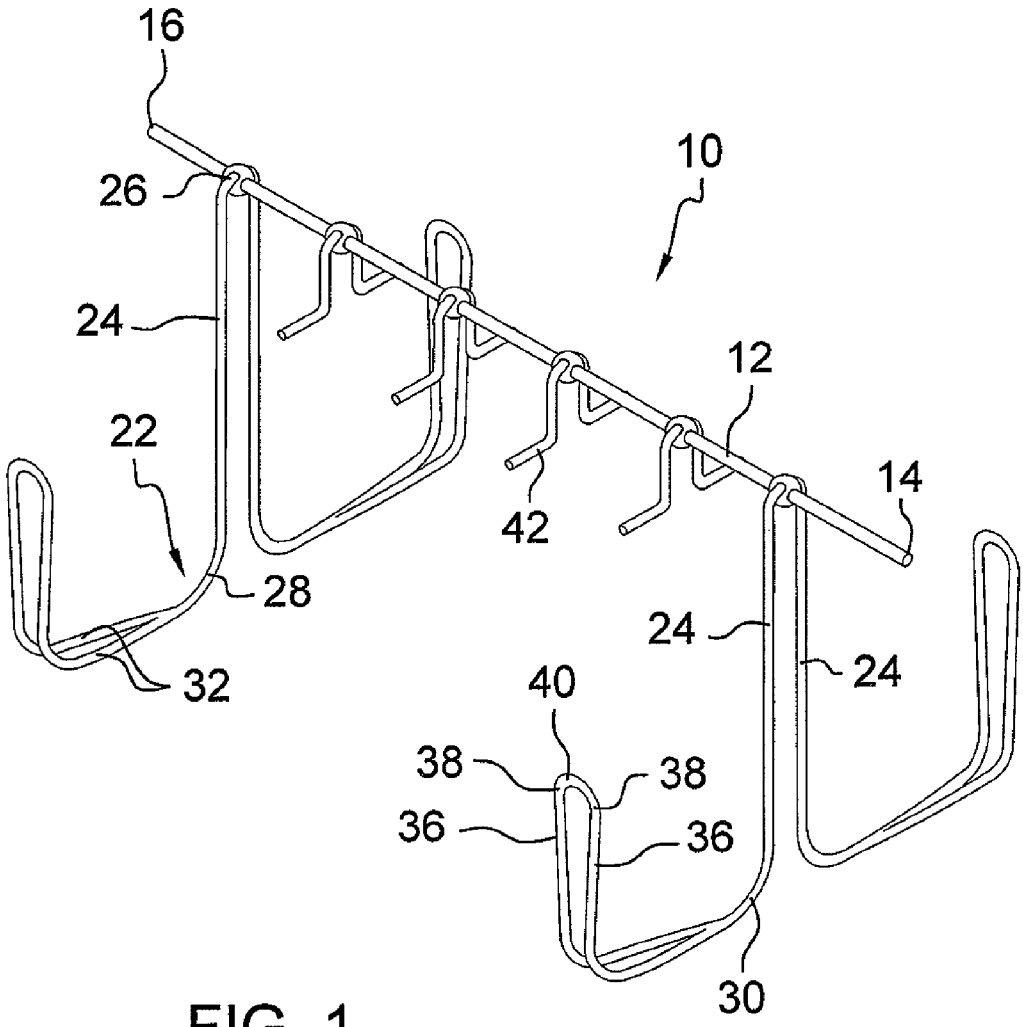
FIG. 1 is a top perspective view of a painting tool cleaning mount assembly and method according to the present invention.
Figure 2:
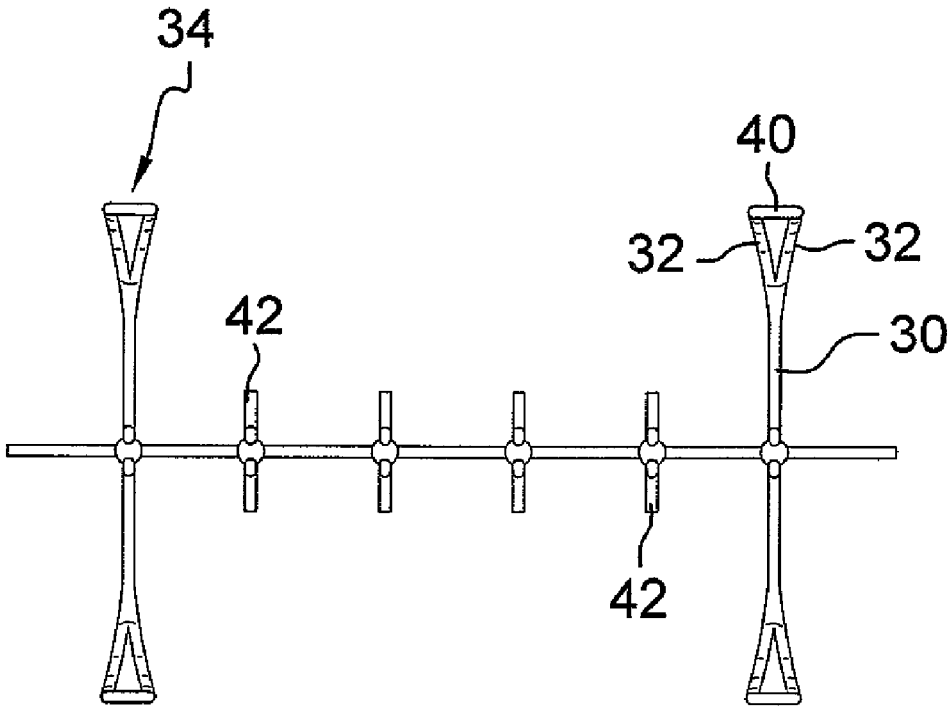
FIG. 2 is a top view of the present invention.
Figure 3:
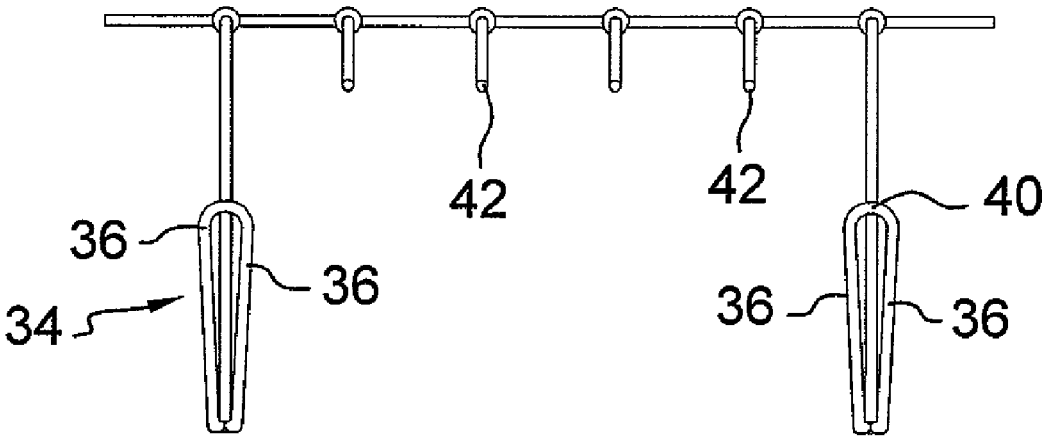
FIG. 3 is a front view of the present invention.

With reference now to the drawings, and in particular to FIGS. 1 through 5 thereof, a new paint brush and roller cleaning and drying aid embodying the principles and concepts of the present invention and generally designated by the reference numeral 10 will be described.

Figure 4:
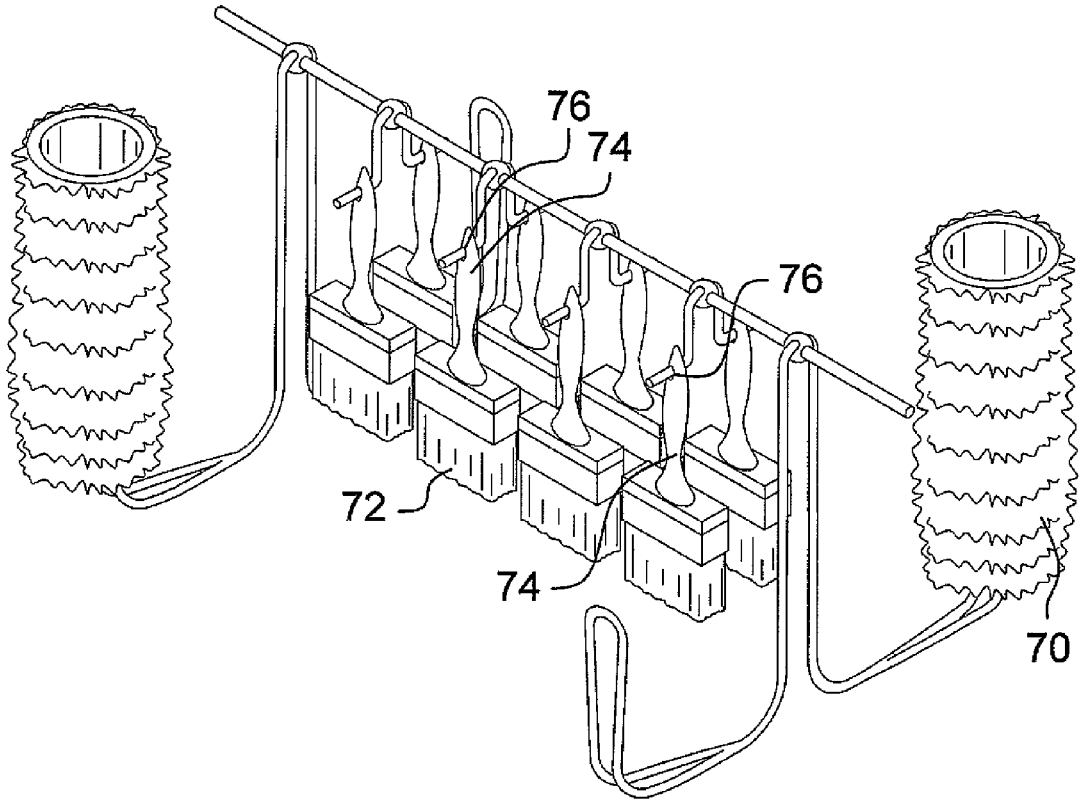
FIG. 4 is an in-use top perspective view of the present invention.
Figure 5:
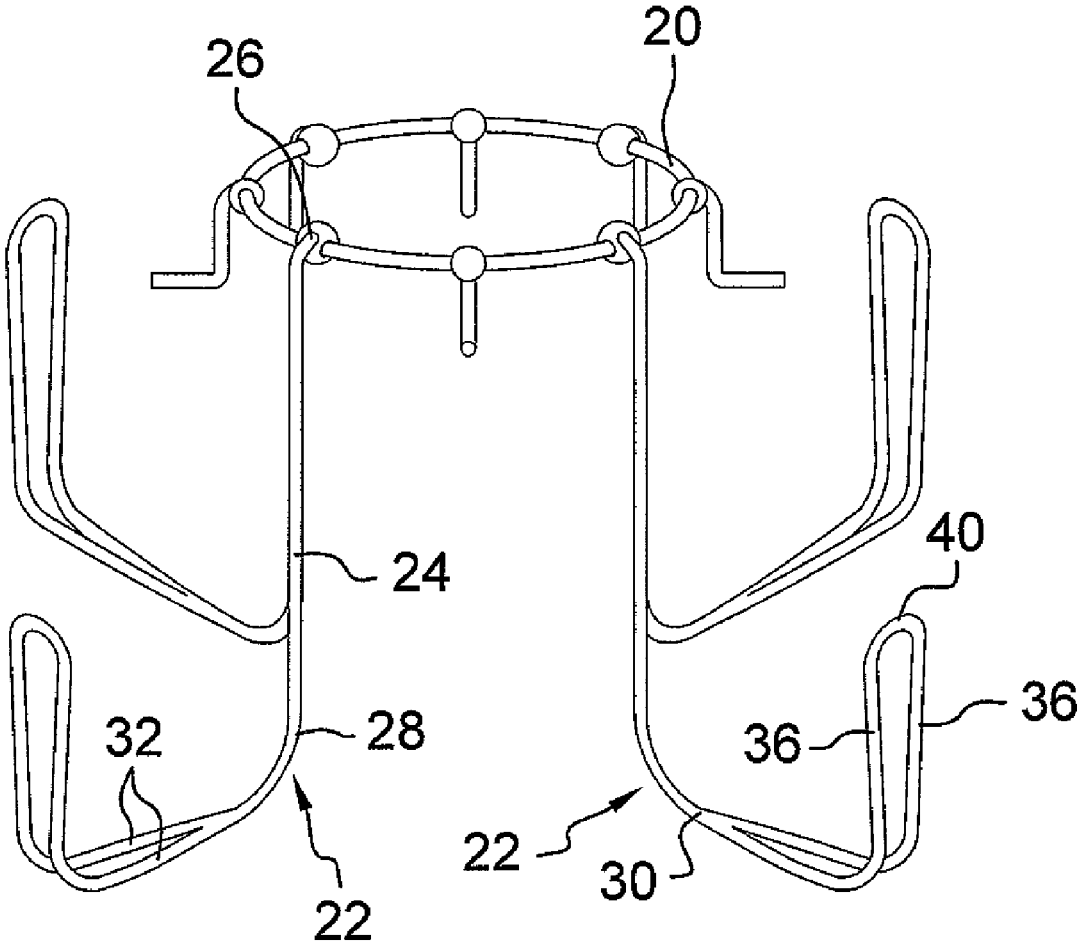
FIG. 5 is a top perspective view of an embodiment of the present invention.

As best illustrated in FIGS. 1 through 5, the painting tool cleaning mount assembly 10 and method generally comprises a central member 12 that is elongated and has a first end 14 and a second end 16. The central member 12 is linearly elongated and may have a length between 6 inches and 18 inches. FIG. 5 shows an embodiment wherein the central member is a closed loop 20 having annular shape with a diameter between 3 inches and 12 inches.

A plurality of legs 22 is attached to and extends downwardly from the central member 20. At least one pair of aligned legs 22 is attached to the central member 12 adjacent to the first end 14, and at least one other pair of aligned legs 22 is attached to the central member 12 adjacent to the second end 16. Each of the legs 22 includes a vertical member 24 having an upper end 26 and a lower end 28. The upper end 26 is attached to the central member 12. The vertical members 24 each have a height between 5 inches and 12 inches. A horizontally orientated stabilizer 30 is attached to the lower end 28 and laterally extends away from the vertical member 24. The stabilizer 30 forms an angle with the vertical member between 85 degrees and 120 degrees. The stabilizer 30 includes a pair of arms 32 diverting outwardly away from the vertical member 24 to increase a width of the stabilizer 30.

The legs 22 each further include a paint roller receiving stanchion 34 that is attached to and extends upwardly from a distal end of the stabilizer 30 with respect to vertical member 24. The stanchion 34 includes a pair of vertical rods 36. Each of the arms 32 is coupled to one of the vertical rods 36 to widen the stanchion 34 to frictionally engage one of a paint roller 70. Each of the vertical rods 36 has a top end 38 and a connecting rod 40 is attached to and extends between the top ends 38 of the vertical rods 36.

The stabilizers 34 of each pair of the legs 22 extend in opposite directly with respect to each other along a line orientated perpendicular to a longitudinal axis of the central member 12 to provide stability to the assembly 10. The assembly 10 may be comprised of metallic wire or tubular shaped plastic members.

A plurality of hooks 42 is provided. Each of the hooks 44 is attached to the central member 12. The hooks 44 are extendable through apertures 76 in handles 74 of the paintbrushes 72 to removably hang the paint brushes 72 from the central member 12.

In use, paint rollers 70 and paint brushes 72 are mounted on the assembly as describe above and as shown in FIG. 4. The assembly 10, along with the paint brushes 72 and paint rollers 70, is then placed in a dishwasher to clean paint from the paint rollers 70 and paint brushes 72. Once the cleaning cycle is complete or when the paint rollers 70 and brushes 72 are dried, the assembly 10 is removed from the dishwasher. The assembly 10 retains the paint brushes 72 and rollers 70 in a vertical orientation while being cleaned.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A painting tool cleaning mount assembly for vertically orienting paint brushes and paint rollers for cleaning, said assembly including:

a central member;

a plurality of legs being attached to and extending downwardly from said central member to support said central member on a support surface, each of said legs including a vertically orientated paint roll receiving stanchion for receiving one of the paint rollers, each of said legs comprising;

a vertical member having an upper end and a lower end, said upper end being attached to said central member;

a horizontally orientated stabilizer being attached to said lower end and laterally extending away from said vertical member;

said stanchion being attached to and extending upwardly from a distal end of said stabilizer with respect to vertical member;

a plurality of hooks, each of said hooks being attached to said central member, said hooks being extendable through apertures in handles of the paintbrushes to removably hang the paint brushes from said central member; and wherein said assembly is positionable in a dishwasher to clean the paint rollers and the paint brushes.

2. The assembly according to claim 1, wherein said central member is a closed loop having an annular shape.

3. The assembly according to claim 1, wherein said central member is linearly elongated and has a first end and a second end, at least one pair of said legs being attached to said central member adjacent to said first end and being aligned with each other, at least one pair of said legs being attached to said central member adjacent to said second end and being aligned with each other.

4. The assembly according to claim 1, wherein said stabilizer forms an angle with said vertical member between 85 degrees and 120 degrees.

5. The assembly according to claim 1, wherein said stabilizer includes a pair of arms diverting outwardly away from said vertical member to increase a width of said stabilizer.

6. The assembly according to claim 5, wherein said stanchion includes a pair of vertical rods each being coupled to one of said arms to widen said stanchion to frictionally engage one of the paint rollers, each of said vertical rods having a top end, a connecting rod being attached to and extending between said top ends of said vertical rods.

7. The assembly according to claim 6, wherein said central member is a closed loop having an annular shape.

8. A painting tool cleaning mount assembly for vertically orienting paint brushes and paint rollers for cleaning, said assembly including:

a central member being elongated and having a first end and a second end, said central member being linearly elongated;

a plurality of legs being attached to and extending downwardly from said central member, at least one pair of said legs being attached to said central member adjacent to said first end and being aligned with each other, at least one pair of said legs being attached to said central member adjacent to said second end and being aligned with each other, each of said legs including;

a vertical member having an upper end and a lower end, said upper end being attached to said central member;

a horizontally orientated stabilizer being attached to said lower end and laterally extending away from said vertical member, said stabilizer forming an angle with said vertical member between 85 degrees and 120 degrees, said stabilizer including a pair of arms diverting outwardly away from said vertical member to increase a width of said stabilizer;

a paint roller receiving stanchion being attached to and extending upwardly from a distal end of said stabilizer with respect to vertical member, said stanchion including a pair of vertical rods each being coupled to one of said arms to widen said stanchion to frictionally engage one of the paint rollers, each of said vertical rods having a top end, a connecting rod being attached to and extending between said top ends of said vertical rods;

said stabilizers of each pair of said legs extending in opposite directly with respect to each other along a line orientated perpendicular to a longitudinal axis of said central member;

a plurality of hooks, each of said hooks being attached to said central member, said hooks being extendable through apertures in handles of the paintbrushes to removably hang the paint brushes from said central member; and wherein said assembly is positionable in a dishwasher to clean the paint rollers and the paint brushes.

9. A method of cleaning paint brushes and paint rollers, said method including the steps of:

providing a mounting, said mounting including;

a central member being elongated and having a first end and a second end, said central member being linearly elongated;

a plurality of legs being attached to and extending downwardly from said central member, at least one pair of said legs being attached to said central member adjacent to said first end and being aligned with each other, at least one pair of said legs being attached to said central member adjacent to said second end and being aligned with each other, each of said legs including;

a vertical member having an upper end and a lower end, said upper end being attached to said central member;

a horizontally orientated stabilizer being attached to said lower end and laterally extending away from said vertical member;

a paint roller receiving stanchion being attached to and extending upwardly from a distal end of said stabilizer with respect to vertical member;

a plurality of hooks, each of said hooks being attached to said central member, said hooks being extendable through apertures in handles of the paintbrushes to removably hang the paint brushes from said central member.

providing a plurality of paint rollers;

extending said stanchions into said paint rollers;

providing a plurality of paint brushes each having a handle;

extending said hooks through apertures in said handles to hand said paint brushes from said hooks;

positioning said mounting with said paint rollers and said paint brushes in a dishwasher to clean the paint rollers and the paint brushes; and removing said paint brushes and said paint rollers from said mounting after said paint brushes and paint rollers are dry.

* * * * *